US009822600B2

(12) United States Patent
Bourgeau et al.

(10) Patent No.: US 9,822,600 B2
(45) **Date of Patent: *Nov. 21, 2017**

(54) SUBSEA ENERGY STORAGE FOR WELL CONTROL EQUIPMENT

(71) Applicants: Transocean Sedco Forex Ventures Limited, George Town Grand Cayman (KY); Aspin Kemp & Associates Holding Corp., Owren Sound (CA)

(72) Inventors: Edward P. K. Bourgeau, Houston, TX (US); Jason Aspin, Charlottetown (CA)

(73) Assignees: Transocean Sedco Forex Ventures Limited, George Town Grand (KY); Aspin Kemp & Associates Holding Corp., Owren Sound (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/290,207

(22) Filed: Oct. 11, 2016

(65) Prior Publication Data

US 2017/0122056 A1 May 4, 2017

Related U.S. Application Data

(63) Continuation of application No. 14/074,602, filed on Nov. 7, 2013, now Pat. No. 9,494,007.

(Continued)

(51) Int. Cl.
*E21B 33/035* (2006.01)
*E21B 33/064* (2006.01)

(Continued)

(52) U.S. Cl.
CPC ..... *E21B 33/0355* (2013.01); *E21B 33/063* (2013.01); *E21B 33/064* (2013.01); *E21B 41/0007* (2013.01)

(58) Field of Classification Search
CPC ... E21B 33/0355; E21B 33/063; E21B 33/064
See application file for complete search history.

(56) References Cited

U.S. PATENT DOCUMENTS 3,680,311 A 8/1972 Harbonn et al.
4,142,368 A * 3/1979 Mantegani ..... B30B 15/22 60/413

(Continued)

FOREIGN PATENT DOCUMENTS

CA 1239090 A * 7/1988 ..... E21B 33/0355
GB 2251639 A * 7/1992 ..... E21B 33/0355

(Continued)

*Primary Examiner* — Matthew R Buck
(74) *Attorney, Agent, or Firm* — Norton Rose Fulbright US LLP

(57) ABSTRACT

A subsea energy storage for well control equipment, wherein stored energy near a well on the sea floor monitors and activates well control equipment independently of, or in conjunction with, hydraulic energy. Energy to the subsea energy storage can be supplied by surface umbilical, remotely-operated vehicle, or by subsea electrical generation from stored hydraulic energy. Stored electrical energy may also recharge stored hydraulic energy. A subsea control system is configured to record data, compare the data to predetermined event signatures, and operate the well control equipment with stored electrical energy.

24 Claims, 6 Drawing Sheets

Related U.S. Application Data

(60) Provisional application No. 61/723,591, filed on Nov. 7, 2012.

(51) Int. Cl.
*E21B 33/06* (2006.01)
*E21B 41/00* (2006.01)

(56) References Cited

U.S. PATENT DOCUMENTS 4,833,971 A * 5/1989 Kubik ..... B30B 15/161 60/428
4,864,914 A * 9/1989 LeMoine ..... F15B 3/00 251/1.3
4,923,008 A 5/1990 Wachowicz et al.
4,955,195 A * 9/1990 Jones ..... E21B 34/16 137/1
6,192,680 B1 * 2/2001 Brugman ..... E21B 33/0355 60/398
6,298,767 B1 * 10/2001 Porter ..... E21B 33/0355 166/344
6,481,329 B2 * 11/2002 Porter ..... E21B 33/0355 166/344
7,159,662 B2 1/2007 Johansen et al.
7,264,050 B2 9/2007 Koithan et al.
7,338,027 B1 3/2008 Whitby et al.
8,651,190 B2 * 2/2014 Dietz ..... E21B 33/064 166/250.01
9,004,178 B2 * 4/2015 Leuchtenberg ..... E21B 17/01 166/345
9,494,007 B2 * 11/2016 Bourgeau ..... E21B 33/0355
2009/0127482 A1 5/2009 Bamford
2011/0114329 A1 * 5/2011 Emecheta ..... E21B 33/0355 166/350
2011/0232912 A1 9/2011 Close
2011/0297396 A1 12/2011 Hendel et al.
2012/0088134 A1 * 4/2012 Wood ..... E21B 33/064 429/90
2012/0111572 A1 * 5/2012 Cargol, Jr. ..... E21B 33/0355 166/363
2012/0197527 A1 8/2012 McKay et al.
2013/0333894 A1 * 12/2013 Geiger ..... E21B 33/0355 166/336
2014/0124211 A1 * 5/2014 Warnock, Jr. ..... E21B 33/0355 166/363

FOREIGN PATENT DOCUMENTS

GB 2266546 A * 11/1993 ..... E21B 33/0355
GB WO 9723708 * 7/1997
GB WO 2008074995 * 6/2008
NO WO 2009045110 * 4/2009
WO 9723708 A1 7/1997
WO 2008074995 A1 6/2008

* cited by examiner

SUBSEA ENERGY STORAGE FOR WELL CONTROL EQUIPMENT

CROSS-REFERENCE TO RELATED APPLICATIONS

This application is a continuation of U.S. patent application Ser. No. 14/074,602 filed on Nov. 7, 2013 and entitled "Subsea Energy Storage for Blow Out Preventers (BOP)," which claims benefit of priority to U.S. Provisional Patent Application No. 61/723,591 filed on Nov. 7, 2012 and entitled "Smart Blow Out Preventer (Bop) With Subsea Energy Storage," both of which are incorporated by reference.

TECHNICAL FIELD

This disclosure relates to subsea wells. More particularly, this disclosure relates to power systems for subsea wells.

BACKGROUND

Existing Blow Out Preventers ("BOP") function on hydraulic systems. For those systems that use electricity, the electrical system is used to power an open loop with no feedback, low power, unidirectional actuator, such as a solenoid. This unidirectional actuator then controls a hydraulic pilot valve that passes a hydraulic power signal to a high power actuator, such as a SPM valve, which in turn passes hydraulic power at flow rates and pressures sufficient to operate a BOP ram or other BOP functions. The release of the electronic actuator, the pilot valve, and the main valve rely on a spring return and are also of open loop design.

Existing BOP systems use electrical power for light loads consisting of small power actuators (described above) and limited sensor and computational capability. This electrical power is delivered from the vessel via an umbilical cable, through a high voltage Alternative Current (AC). The high voltage needed to maintain peak current, however, leads to insulation stress and breakdown, allowing salt water ingress, galvanic corrosion of the cable, and possible hydrogen embrittlement of metal conductors. The high current requirement results in selection of heavy, non-flexible cable that is difficult to terminate and causes kinking issues. These cables are difficult to store onboard the vessel. Additionally, communications lines may be integrated in the umbilical and AC power creates magnetic field disturbances and line noise in the communications lines.

For deep water applications, deliverable current is limited, both by the extreme distances of transmission and by the risk of communication line interference. Because of the risk of losing the power link with the surface, existing BOP components are designed to operate under no-power conditions. For example, the unidirectional actuator that controls the hydraulic pilot valve incorporate the aforementioned spring return that allows the valve to turn off even when power is lost. However, engagement of the actuator requires sustained power from the surface, which limits the amount of actuators that can be engaged at any one time. Moreover, loss or disturbance of power from the surface results in loss of communications and further causes a change in position of all powered solenoid actuators. This may cause unwanted hydraulic changes to the BOP functions.

The few sensors used on existing BOP technology measure pressure, flow and other physical parameters in an attempt to provide feedback for components operating in an open loop by attempting to confirm that a particular function was actuated or completed. The use of central sensors forces only one function to be operated at a time because the feedback of central pressure and flow sensors would be unclear if multiple functions were operated simultaneously. The integrated nature of the system, where there is extensive shared infrastructure, forces the use of significant levels of single application software. This software, and the off-line support systems for it are written for a very limited number of applications. The result is poor predictability, difficulty in troubleshooting, and weak industry-wide support

SUMMARY

In one embodiment, a device and method of storing electrical energy near a well on the sea floor and activating well control equipment with the stored electrical energy. Subsea actuators on sea floor equipment may include an electrical design. Subsea actuators may alternatively include a hybrid electrical/mechanical design, in which a main hydraulic power valve may be electrically controlled, allowing one or more electrically powered hydraulic pumps to operate a shear ram in combination with, or independently of, a pressurized hydraulic system. According to one embodiment, cylinders in the shear ram are moved a first distance under stored electrical power and are then moved a second distance under stored hydraulic energy, where the first distance may be the portion of a path the shear ram traverses before contacting an obstruction, such as a drill pipe.

According to another embodiment, stored electrical energy may be used to operate a pump to generate hydraulic pressure. The generated hydraulic pressure may be stored at the sea floor. In certain embodiments, hydraulic fluid may be recaptured for later use, rather than exhausting the fluid to the sea. Excess hydraulic fluid may be stored at ambient pressure near the well on the sea floor. This excess hydraulic fluid may be pressurized by the subsea pump using stored electrical energy. In one embodiment, a remotely-operated vehicle (ROV) may deliver either ambient-pressure hydraulic fluid or pressurized, hydraulic fluid. When pressurized fluid is delivered by the ROV, the hydraulic energy from the ROV, may operate a subsea pump as a generator to recharge the stored electrical energy in certain embodiments.

According to one embodiment, the device and method include a complete stand-alone power and communications system, multiple sensors, event and signature memory, closed-loop feedback on mechanical positioning, and math models of actuator processes. Well control equipment may be activated based on data received from one or more sensors near the well. In one embodiment, data may be wirelessly received from a sensor near the well. In certain embodiments, data received from one or more sensors may be recorded for a period of time and compared to event signatures for the purpose of determining that an event has occurred. In addition, the overall state of the BOP or well control equipment may be determined from the received data.

According to one embodiment, there is an apparatus comprising well control equipment and a subsea electrical power supply coupled to the well control equipment and configured to operate the well control equipment. There is an apparatus further comprising a hydraulic reservoir and a hydraulic line coupled to the hydraulic reservoir and coupled to the well control equipment, the hydraulic line configured to operate the well control equipment in combination with the subsea electrical power supply. In one embodiment, the apparatus further comprises a hydraulic valve, a hydraulic actuator coupled to the hydraulic valve, and a control system coupled to the hydraulic actuator and coupled to the subsea energy storage system, the control system configured to operate the well control equipment with electrical energy from the subsea electrical power supply and hydraulic energy from the hydraulic line. In still another embodiment, the well control equipment comprises a shear ram. Subsea energy storage is used to move the shear ram a first distance and a hydraulic actuator is used to move the shear ram a second distance.

In certain embodiments, the apparatus further comprises a sensor coupled to the control system, in which the control system is configured to activate the well control equipment based, at least in part, on data received from the sensor. In one embodiment, the well control equipment is wirelessly coupled to the control system. In another, the control system is wirelessly coupled to the sensor. According to one embodiment, the apparatus is further configured to record data from the sensor for a period of time, compare the recorded data to predetermined event signatures, and determine an event has occurred based on the step of comparing. According to another embodiment, the subsea power supply is configured to independently operate the well control equipment. In still another embodiment, the apparatus further comprises a subsea pump coupled to the hydraulic line and coupled to the subsea electrical power supply, the subsea pump configured to generate hydraulic pressure in the hydraulic line from energy in the subsea electrical power supply.

In one embodiment, there is a hydraulic reservoir that comprises an ambient-pressure hydraulic reservoir, and in which the subsea pump is configured to pressurize hydraulic medium of the ambient-pressure hydraulic reservoir to operate the hydraulic line. In still another embodiment, there is a port configured to receive ambient pressure hydraulic medium from an ROV. According to one embodiment of the present disclosure, there is a port configured to receive pressurized hydraulic medium from an ROV, in which the subsea pump is configured to operate as a generator to recharge the subsea electrical power supply from the received pressured hydraulic medium.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF SUMMARY OF THE DRAWINGS

For a more complete understanding of the disclosed system and methods, reference is now made to the following descriptions taken in conjunction with the accompanying drawings.

DETAILED DESCRIPTION

In one embodiment, a blowout preventer (BOP) system may include a closed-loop hybrid electric/hydraulic system. Subsea energy storage is provided, allowing as-needed delivery of electrical power, such as through a low voltage, high current signal, to well bore electric components.

Figure 1:
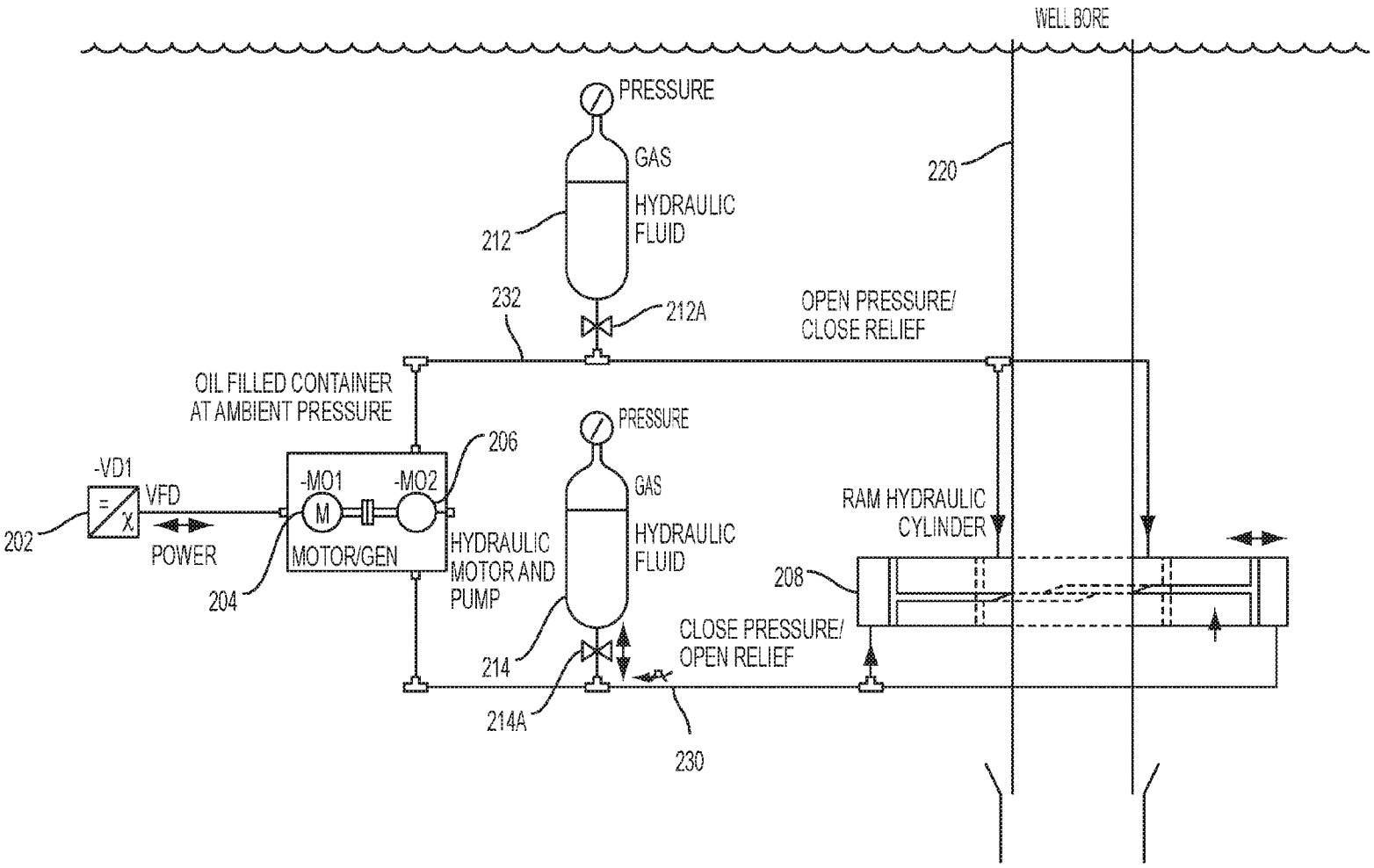
FIG. 1 is a schematic representation of an embodiment of a blowout preventer (BOP) hybrid ram.

FIG. 1 shows a high pressure ram hydraulic cylinder 208 with a push cylinder design in place around well bore 220. Although certain ram designs are illustrated in the system of FIG. 1, other types of rams may be used. Drive and sensor pack 202 may regulate electric power to motor 204. Motor 204 may be connected to hydraulic pump 206, which moves hydraulic medium, such as hydraulic fluid, in closed hydraulic line 230 to press the ram cylinders in the closing position. Hydraulic fluid may be reversed in direction through the motor 204 to operate the motor 204 as a generator. A shear seal ram, such as the one depicted in ram 208, has a region of low-power flow, where the cylinders move unobstructed, and a region of high-power flow, where the cylinders engage and cut an obstruction such as well bore 220 casing (not shown) or drill pipe (not shown).

In conventional shear ram systems, valves to existing subsea, pressurized hydraulic fluid tanks are used to manipulate the cylinders through both low-power and high-power regions. As a hydraulic accumulator tank moves hydraulic fluid into the close line the pressure falls rapidly. In conventional ram systems, the highest pressure zone of the hydraulic tanks is wasted on moving the cylinders through the low-power region, where the cylinders are simply moved into place to contact the obstruction to be cut.

The present embodiment provides increased efficiency by using hydraulic pump 206 to move hydraulic cylinders of ram 208 through the low-power region. When the cylinders contact an obstruction to be cut, pressurized hydraulic fluid tank valve 214A may be opened allowing high-pressure hydraulic fluid from tank 214 into the closed hydraulic line 230. The high-energy hydraulic fluid may assist in closing the cylinders of ram 208 to shear an obstruction in the well bore 220. In this way, the high-energy fluid is utilized for cutting, rather than just moving the cylinder through the low power region. Although a hybrid electrical/hydraulic system is described, the system may also use the hydraulic pump 206 to operate the cylinders of ram 208 through both the low-power phase and high-power phase.

The use of electrical components, such as the pump 206, in the subsea system may allow redundancy to be increased. For example, the pressurized hydraulic fluid within tank 214 may be used to move the cylinders of ram 208 through the low-power region. Likewise, pump 206 may drive the cylinders of ram 208 through the high-power region. In one embodiment, sea water may be used in place of hydraulic fluid, such as in emergency situations when hydraulic fluid is unavailable. Hydraulic fluid may later be flushed through the subsea system to remove contaminants left by the sea water.

The closed-loop design of the embodiment shown in FIG. 1 may also yield additional benefits. For example, tank 214 can be recharged from pump 206 by closing valves (not shown) in close line 230. In addition, with pump 206 attached to both close line 230 and open line 232, the pump further assists ram 208 by pulling hydraulic fluid from the shear side of the cylinders into the open line 232. Where conventional systems exhaust used hydraulic fluid into the open ocean, some embodiments of the subsea system disclosed in FIG. 1 may reuse the hydraulic fluid. Reusing hydraulic fluid is environmentally sensitive. Further, when hydraulic fluid is reused, higher quality hydraulic fluid may be used that is better tailored to ram 208. Also, monitoring of the repressurization of tank 214 or tank 212 provides an additional indicator of the position of the cylinders within ram 208. Finally, the electrical hydraulic hybrid design, as disclosed herein removes the need for the hydraulic pilot valve of conventional BOP systems.

Figure 2:
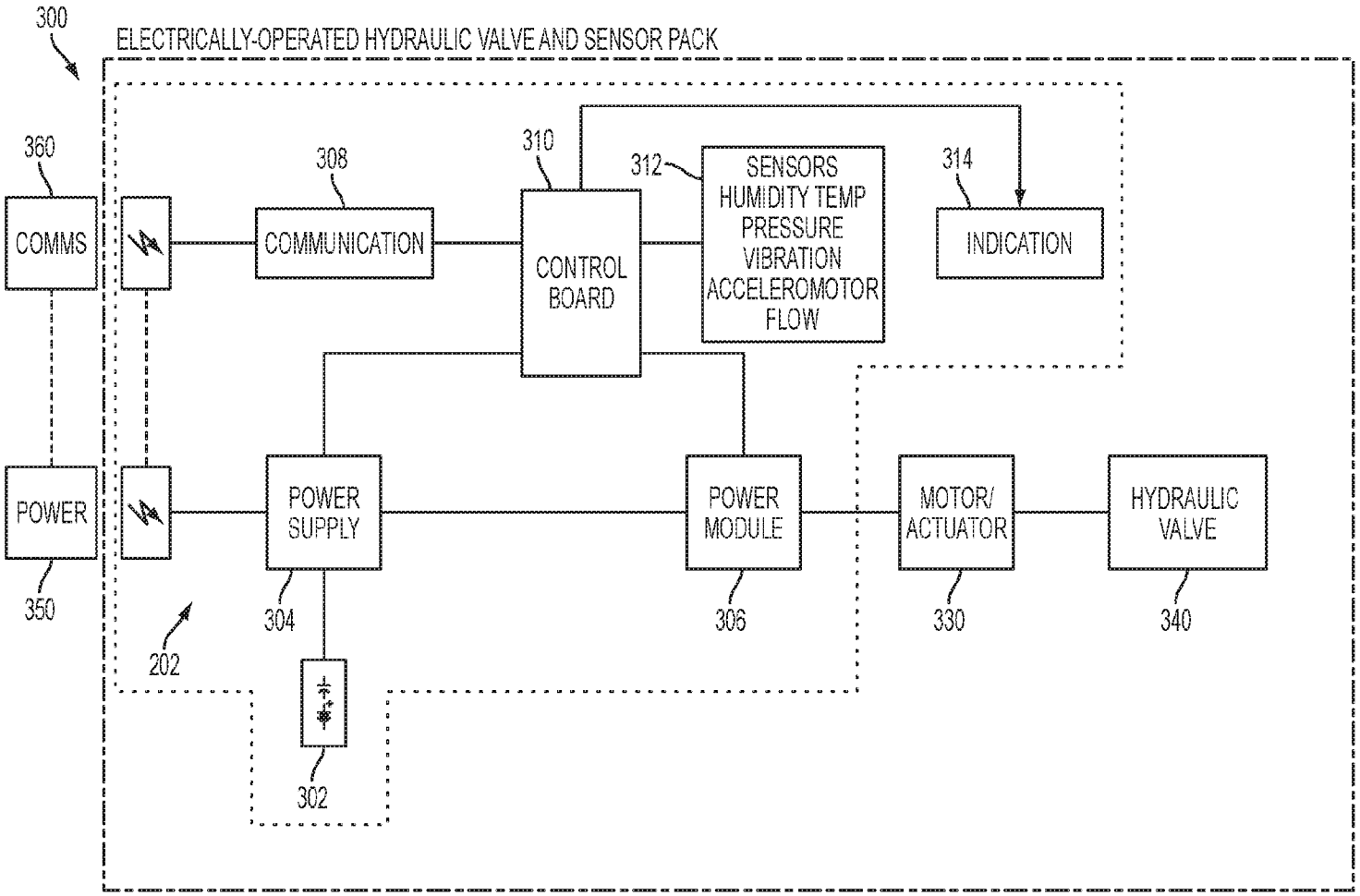
FIG. 2 is a block diagram illustrating an electrically-operated hydraulic valve and sensor pack according to an embodiment of the present disclosure.

A subsea electrical/hydraulic design may also provide other functionality. With the availability of the subsea stored electrical subsystem a BOP may perform local processing of data. FIG. 2 shows a block diagram of the electrical system according to one embodiment of the present disclosure. Components located within the block diagram may be self-contained with the motor and hydraulic valve, as shown in FIG. 2, or they may be independent of the motor and/or valve. In some embodiments, certain components of FIG. 2 may be incorporated in the drive and sensor pack 202 of FIG. 1. Electrical power may enters system 300 from power connection 350. Power may be stepped through voltage levels with a transformer and/or conditioned in power supply 304 and power module 306. The power module 306 may also recharge or draw power from an internal energy storage device 302. Power module 306 may contain a variable-frequency drive for motor/actuator 330. Power supply 304 may also power control board 310 and may power one or more sensors 312 within the valve and sensor pack 202.

The control board 310 may include memory and a processor. The processor may be configured to perform functions, such as collection of data from sensors 312 and control of motor 330 and/or valve 340 and other functions described in this disclosure. In one example, the control board 310 may be configured to activate the shear ram with stored electrical energy to move the shear ram a first distance and activate the shear ram with stored hydraulic energy to move the shear ram a second distance.

Control board 310 may receive power from power supply 304 and information processed by communication block 308, which may be received from communications connection 360. The communications connection 360 may be a wireless connection without galvanic electric connections, which removes traditional electrical connectors and the water tight seals used to insulate the electrical connects from sea water. Communication transmissions may enter and leave the valve and sensor pack 202 via connection 360. In addition, communication block 308 may incorporate wireless technology for communicating with the sensors 312. Embedded sensors 312 may report status information to control board 310. One or more sensors may provide humidity, temperature, pressure, vibration, acceleration, flow, torque, position, power, or other information particular to a given valve, motor, or actuator. Control board 310 telemeters the raw measurements of sensors 312 for reporting purposes to the surface or to other subsea components. In addition, control board 310 may perform calculations, converting raw measurement data into interpretable telemetry, and/or other processing. For example, control board 310 may apply user-programmable calibrations to sensors 312. Because power may be stored and supplied in the subsea environment, system 300 may receive closed-loop feedback on any mechanical device. Moreover, control board 310 may include memory to allow recording of electrical signatures of one or more remote devices. Control board 310 may then interpret status information from the remote devices by comparing the electrical signatures with predetermined electrical signatures or historical signatures for the remote devices. For example, the control board 310 may be pre-programmed with an electronic signature for a shear ram failure that includes approximate measurements over time from a shear ram that may indicate a failure of the shear ram. The recorded electronic signature for the shear ram may then be compared with this pre-programmed electronic signature to determine if a failure has occurred or if service is required.

Communications between control board 310, actuators, motors, valves, rams, indicators, and sensors may be by wired connection. In certain embodiments, wireless communication between components may be implemented, such as through radio frequency (RF) communications.

Control board 310 may do more than just communicate with and interpret information from sensors 312. The connection to power module 306 may allow control board 310 to actively manipulate motor/actuator 330 as well as valve 340. Control board 310 may include dynamic memory, allowing aggregation of sensor data over time with time-stamps. According to one embodiment, control board 310 may record data over a set period of time to determine normal or even abnormal operating parameters and then, using on-board comparison algorithms, compare current data parameters to these historical parameters. In this way, control board 310 can determine whether an event has occurred. Moreover, the memory of control board 310 allows data logging to not be restricted by bandwidth limitations or line noise in the communications line 360. Thus, higher resolution data capture is possible. Operators may then download particular time-stamped event logs as desired through the communications line 360. Control board 310 may send detailed information about the valve's health and status, such as how fast the valve closed, how much energy was used to close the valve, the temperature increase during valve closure, high vibration or acceleration, etc. Moreover, control board 310 may compare the valve closure to previous closures to determine the health of the valve.

According to one embodiment, control board 310 autonomously manipulates well equipment according to preprogrammed conditions. Thus, even if communication is cut off to the surface, subsea control board 310 possesses the power and the processor capability to independent operate the BOP. Control board 310 may also facilitate day-to-day operational corrections without the need for human intervention.

According to another embodiment, control board 310 may process mathematical models of normal or abnormal operation of various components of well bore equipment. For example, given standard hydraulic start pressure, head-loss algorithms, depth of equipment, shear strength of an obstruction to be cut, etc., mathematical modeling will be able to calculate or estimate the amount of hydraulic fluid exiting a given accumulator. If that number differs by a certain amount, control board 310 may issue an event code that would alert operators on the surface. In addition, control board 310 may take autonomous action based on the event code. Over time, aggregated data and mathematical modeling provides operators additional information regarding the operation of a particular BOP. Operators may then update control board 310 autonomous response parameters according to predicted signatures.

Subsea processing of data may allow for quicker control of equipment. For example, existing hydraulics may measure flow in limited places due to topside communication limitations discussed above. As a result, existing subsea hydraulic systems are prevented from simultaneously opening two valves upstream of a single flow meter because the operator would lose information regarding the flow through each individual valve. With the use of electrical system control, however, each valve could maintain its own powered valve and sensor pack complete with on-board sensors to measure flow, temperature, vibration, pressure, etc. Thus, more sensors and more actuators may be operated independently. Also, electrical control systems allow operators to make more adjustments and make adjustments more rapidly. As such, this feature may reduce time to emergency disconnect due to vessel problems.

In deep sea, high-pressure environments, visual valve status may be limited by the availability of power and access to systems for processing data. According to one embodiment, an indication of the status of the valve may be available. Indication block 314 of FIG. 2 may receive information from sensors 312 through control board 310. Indication block 314 may display certain aspects of the valve status visually, audibly, magnetically, etc. For example, a closed hydraulic valve may trigger an encased green light emitting diode (LED) visible on the outside of the valve by a remotely operated vehicle (ROV). By way of example, a closed valve where the hydraulic fluid used exceeded normal parameters may display both a green LED and a yellow LED. In significantly high pressure environments, an LED display may be impractical. In certain embodiments, indication block 314 may employ a magnetic data output system. For example, polarization of an electromagnet may move a compass mounted on the outside of the valve or inside an ROV. In certain embodiments, audible cues may be initiated by indication block 314. Two pings, for example, may indicate a closed valve whereas three pings indicate a closed valve with pressure problems. Although the present example is directed at a blowout preventer (BOP) valve, this design may also be applied to other well bore equipment.

According to one embodiment, the closed-loop electrical control system described herein may be modular in design, forgoing the use of a central topside processor and infrastructure. In this example, multiple components of well equipment may contain identical valve and sensor packs, as described in FIG. 2. Subsea actuators may contain the same software thus standardizing telemetry and calculations.

Figure 3:
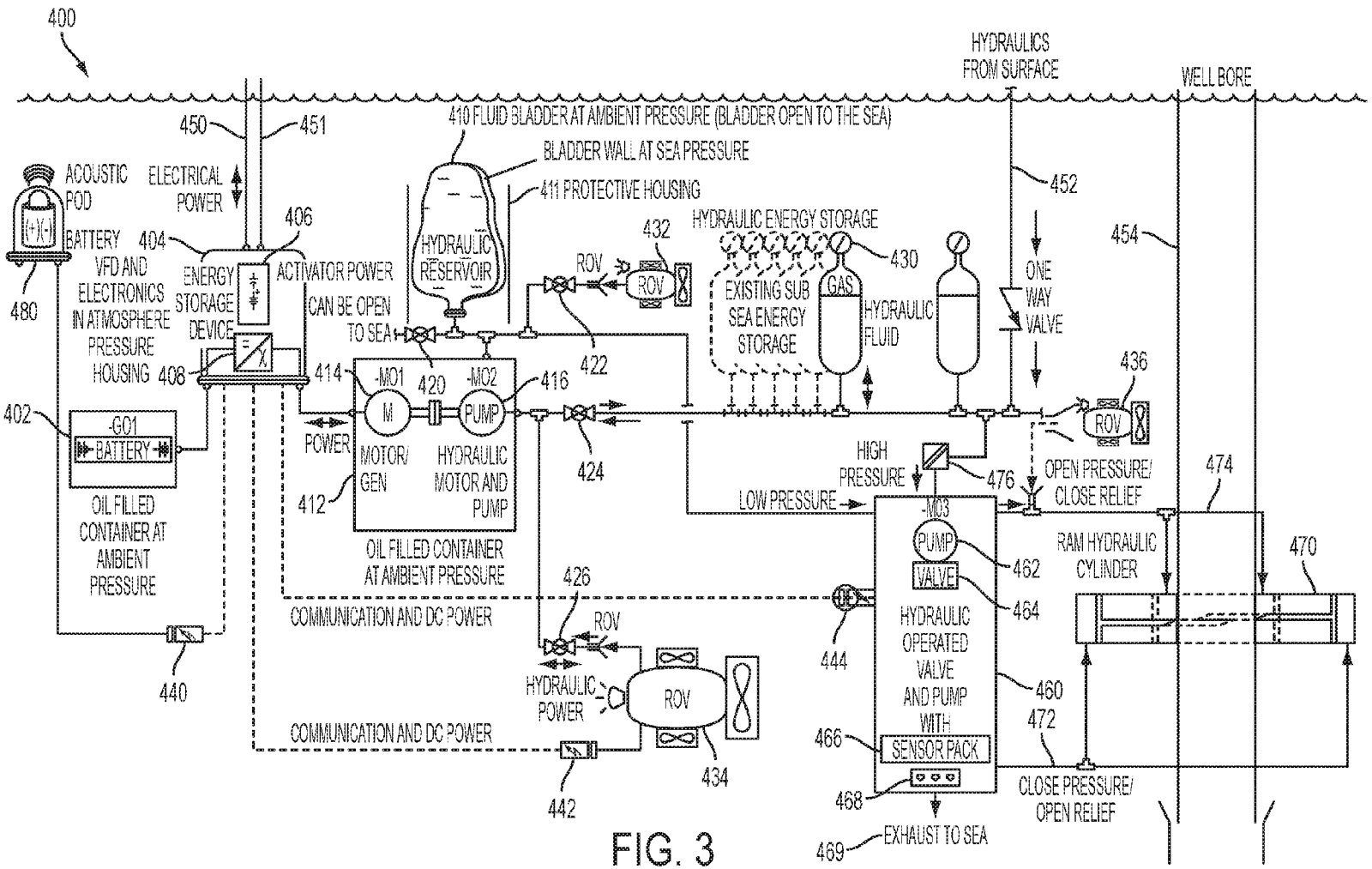
FIG. 3 is a block diagram illustrating an embodiment of a blowout preventer (BOP) power system, hydraulic reservoir subsystem, and remote-operated vehicle (ROV) recharge systems.

System 400, as depicted in FIG. 3, is an embodiment of a BOP according to the present disclosure. Electrical power may be fed in and out of system 400 through umbilical 450 (or secondary umbilical 451). Either alternating current (AC) or direct current (DC) power may be transferred, with electronics package 404 converting and/or conditioning the power as needed. Umbilical 450 may also comprise communication lines. For deep deployments, the long distance transmission capability of AC power may be employed. In conventional systems without subsea energy storage, high current AC power is transmitted through the umbilical, as described above, and result in line noise and communications disturbances. Because system 400 contains subsea energy storage, however, both the current and voltage of power transmission through the umbilical 450 may be reduced. While major events in subsea system 400 may momentarily consume high power, many components of the subsea system 400 may operate under normal conditions in a low-power sensing mode. Power sent to subsea system 400 through the umbilical 450 may be low current and low voltage during normal conditions. Small amounts of additional electrical power may be transferred to storage within the subsea system 400 over the umbilical 450 to trickle charge of the storage. When high power is required, some of the additional power may already be stored subsea and reduce the additional power required to be transferred over the umbilical 450. This trickle charge capability may reduce the deleterious effects of existing subsea AC power systems. In addition, with the low power requirements, DC power may be fed on umbilical 450. In certain situations, umbilical 450 may transfer power from subsea system 400 topside, such as during storage device 402 reconditioning.

Subsea power storage may allow each subsea actuator/sensor pack to be independent of any complex power source. Power distribution is low voltage and can be on the same conductors that are used for communication. In embodiments with DC power distribution, alternating electric and magnetic fields through the conductors is reduced, which removes a source of noise from the communications lines. The storage of power in a subsea system, such as the lower main riser package (LMRP), removes high peak currents from the umbilical cable circuit. Further, in certain embodiments, the subsea systems may operate with momentary or continuous loss of power from the surface. In embodiments with trickle charge capability, the management of voltage may be simpler and reduce the use for complex transformers at the subsea equipment. Further, surface-level Uninterrupted Power Systems (UPS) may be provided to supply DC power over the umbilical for additional redundancy. DC power on the surface-to-subsea umbilical lines also eliminates complex impedance issues and greatly simplifies the design of the cable. Because lower peak currents allow for smaller cable, more cable may be stored on the surface vessel. Lower gauge cable is also easier and faster to terminate, resists kinking, and simplifies repairs. Lower gauge cable is also faster and less expensive to replace, and can be terminated with existing ROV technology.

Electronics package 404 may regulate power through system 400. In the embodiment shown in FIG. 3, electronics package 404 may accept a trickle charge from umbilical 450, condition the electrical power, and charge storage device 402. Storage device 402 may be of any battery chemistry known in the art, such as lithium ion (LiIon), nickel cadmium (NiCd), or nickel metal hydride (NiMH). In addition or alternate to chemical batteries, storage device 402 may comprise fuel cells, capacitors, or fly wheels. Storage device 402 may also contain a non-rechargeable reserve battery for emergency operations. Alternatively, reserve batteries and localized energy storage devices, such as energy storage device 302, may be located within electronics package 404 or at other locations in system 400. In one embodiment, storage device 402 may exist in an oil-filled container at ambient pressure.

Electronics package 404 monitors and maintains an appropriate charge for storage device 402. In the embodiment shown, electronics package 404 may contain electronics and sensors such as associated with FIG. 2 above. Electronic package 404 may also include a variable speed drive 408 for use in driving motor 414. Additional power for use internally in electronics package 404 or for use externally may be stored in energy storage device 406. Energy storage device 406 may also be used for conditioning power. Electronics package 404 may also contain, or be connected to, indication components such as acoustic pod 480.

Subsea-stored electrical energy may be used to drive motor 414, which in turn is coupled to hydraulic pump 416. Motor 414 and pump 416 may have multiple uses in the subsea system. For example, pump 416 may accept hydraulic recharge fluid from ROV 434 and pump the fluid into hydraulic reservoir 410. Hydraulic reservoir 410 may be an ambient pressure fluid bladder contained in protective housing 411. Pump 416 may also transfer hydraulic fluid from ambient-pressure reservoir 410 to high-pressure hydraulic energy storage tanks 430. Pump 416 may pressurize tanks 430, creating hydraulic energy storage for use in ram 470 or for use in charging battery 402. Pump 416 may also accept hydraulic fluid from the surface along umbilical 452 for use in resupplying hydraulic reservoir 410. Pump 416 may also accept hydraulic fluid from ROV 432. In addition, pump 416 may drive motor 414 to recharge storage device 402. In power generation mode, ROV 434 pushes hydraulic fluid through pump 416 to ambient pressure reservoir 410. Pump 416 turns motor 414, which generates electricity to charge storage device 402. In an alternate embodiment, hydraulic fluid may be discarded to the sea through external valve 420. Hydraulic fluid may also or alternately be sent through pump 416 from pressurized hydraulic energy storage tanks 430.

System 400 provides additional uses for an ROV. As mentioned, ROV 432 and ROV 434 may replenish hydraulic fluid to system 400. ROV 434 may also recharge storage device 402 through pump 416 and generator 414. In addition, ROV 434 may communicate directly with electronics package 404 in the event of problems with umbilical 450. Likewise, ROV 434 may provide raw DC power to electronics package 404 for use in powering system 400 or for recharging storage device 402. ROV 434 connects through induction and RF coupling device 442 which is capable of transferring both power and communications without a copper to copper connection.

System 400 may include a conventional hydraulic energy storage subsystem. Pressurized hydraulic accumulator tanks 430 may be coupled to hydraulic operated valve and pump unit 460. Unit 460 contains pump 462, valve 464, sensor and electronics pack 466, and indicator 468. According to conventional hydraulic ram operation, high pressure hydraulic fluid may be passed through regulator 476 to valve 464 where it is directed to open or close ram 470. Excess hydraulic fluid may be exhausted to the sea through port 469. In the embodiment of FIG. 3, pump 462 may assist in the opening or closing of ram 470 cylinders. Pump 462 may draw low-pressure hydraulic fluid from hydraulic reservoir 410 or from ROV 432. Valve 464 may then direct the hydraulic fluid pressurized by pump 462 along either hydraulic line 472 or line 474 to close or open, respectively, the cylinders of ram 470. According to one embodiment, unit 460 also contains electronics and sensor pack 466. Electronics and sensor pack 466, as described in relation to FIG. 2, may record and telemeter measurements such as flow rate, vibration, acceleration, pressure, temperature, humidity, valve position, torque, or power. Electronics sensor pack 466 may be powered from electronics package 404 through, for example, induction and RF coupling 444. In addition, electronics and sensor pack 466 may include an internal energy storage device. Electronics sensor pack 466 may transmit communications along the power line or it may maintain separate hardwire or wireless communication connection with electronics package 404. Indicator 468 may receive data and information from electronics and sensor pack 466 or from electronics package 404, and displays the information accordingly. For example, indicator 468 may employ any of the systems discussed in relation to indication block 314 in FIG. 2. In certain embodiments, the indicator 468 may include a video camera interface for interfacing with a human at a remote location.

In certain other embodiments, the indicator 468 may be a wireless interface to allow reporting of valve data to a hand held device accessed by a technician while the BOP is accessible on a ship deck or in a storage yard. While certain components of the subsea system are located on deck or in the storage yard, they may be provided power and communications interfaces to allow receiving of sensor data and verifying of operational components before installation subsea. Additionally, close loop hydraulic circuits discussed elsewhere allow operation of the BOP on the ship deck of in the storage yard without top-side hardware and hydraulic fluid.

Figure 4:
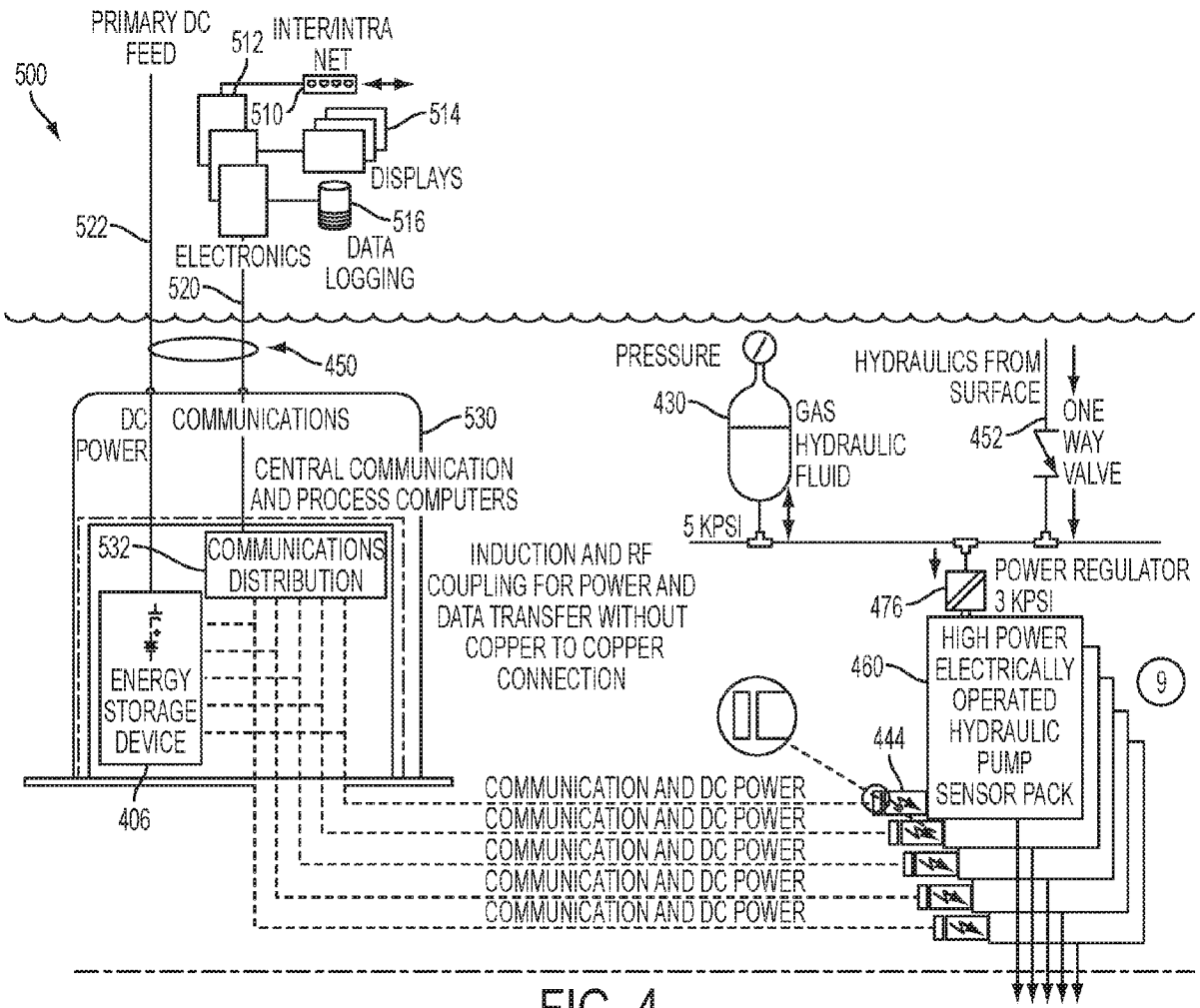
FIG. 4 is a block diagram depicting one embodiment of an autonomous actuator control system.

FIG. 4 depicts the communication layout according to one embodiment of the present disclosure. In FIG. 4, electronics package 530 has been expanded to communicate with multiple hydraulic operated valve and pump units 460. In this embodiment, control board 310, for example, may have multiple input/output ports channeled through a communications distribution hub 532, such as a multiplexer/demultiplexer. Control board 310 located within electronics package 530 may receive and process sensor data from within each of five hydraulic operated valve and pump units 460, as shown in FIG. 4. In FIG. 4, primary topside power 522 may be trickle charged to energy storage device 406, which then powers pump units 460. Because energy storage device 406 or storage device 402 may possess sufficient power to run hydraulic-operated valve and pump units 460, restrictions on topside power 522 may be reduced and allow use of low voltage, low amperage, AC, or DC power.

Topside electronics 512 may communicate with electronics package 530. Telemetry may be sent topside and operational commands may be conveyed to well equipment. Telemetry and executed commands may be logged on data logging equipment 516. Telemetry may be displayed on topside displays 514 and also sent to remote locations via a internetwork or intranetwork 510. Commands may also be relayed via network 510.

Figure 5A:
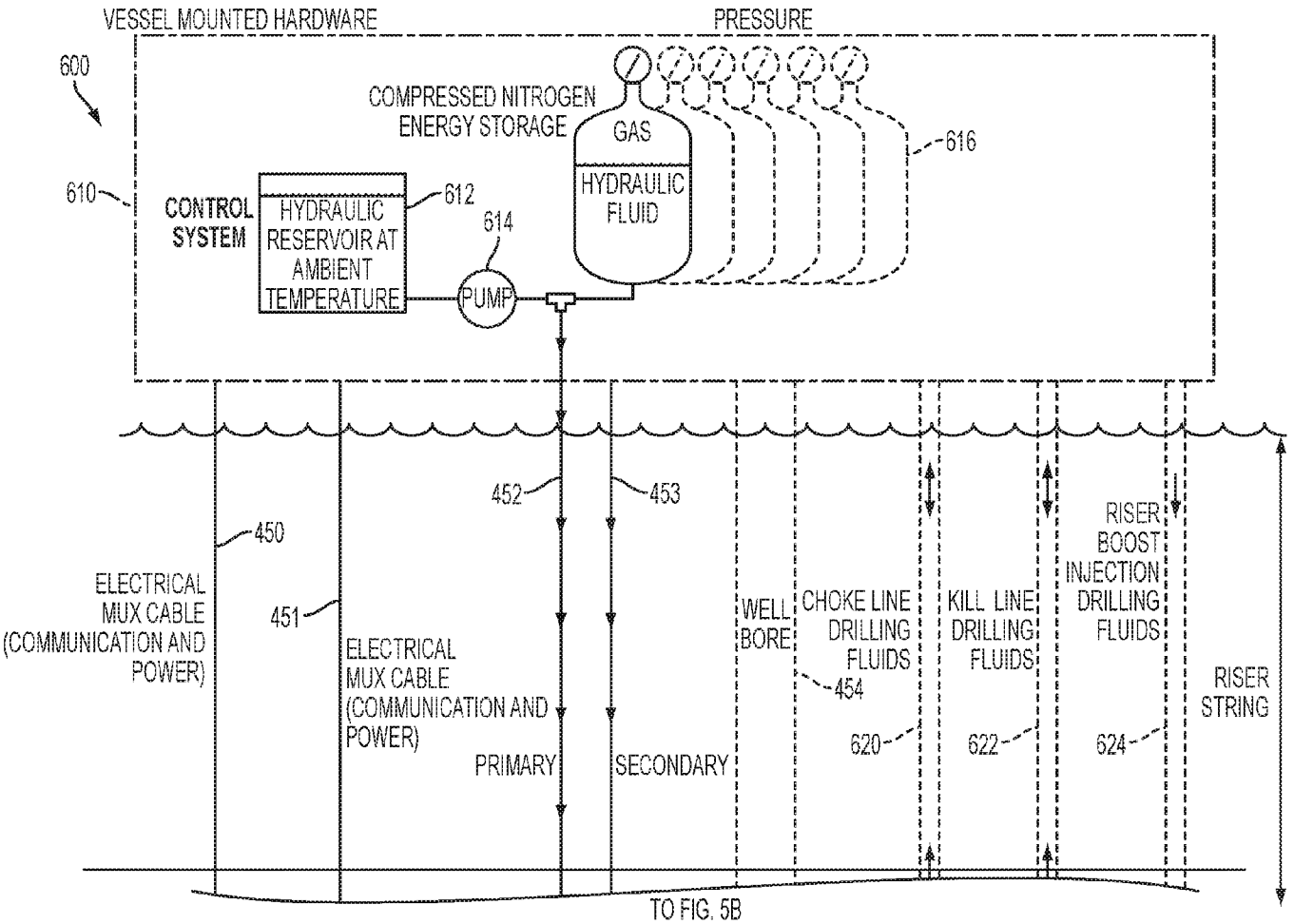
FIG. 5A is a block diagram depicting one configuration of a blowout preventer (BOP) system according to one embodiment of the present disclosure.
Figure 5B:
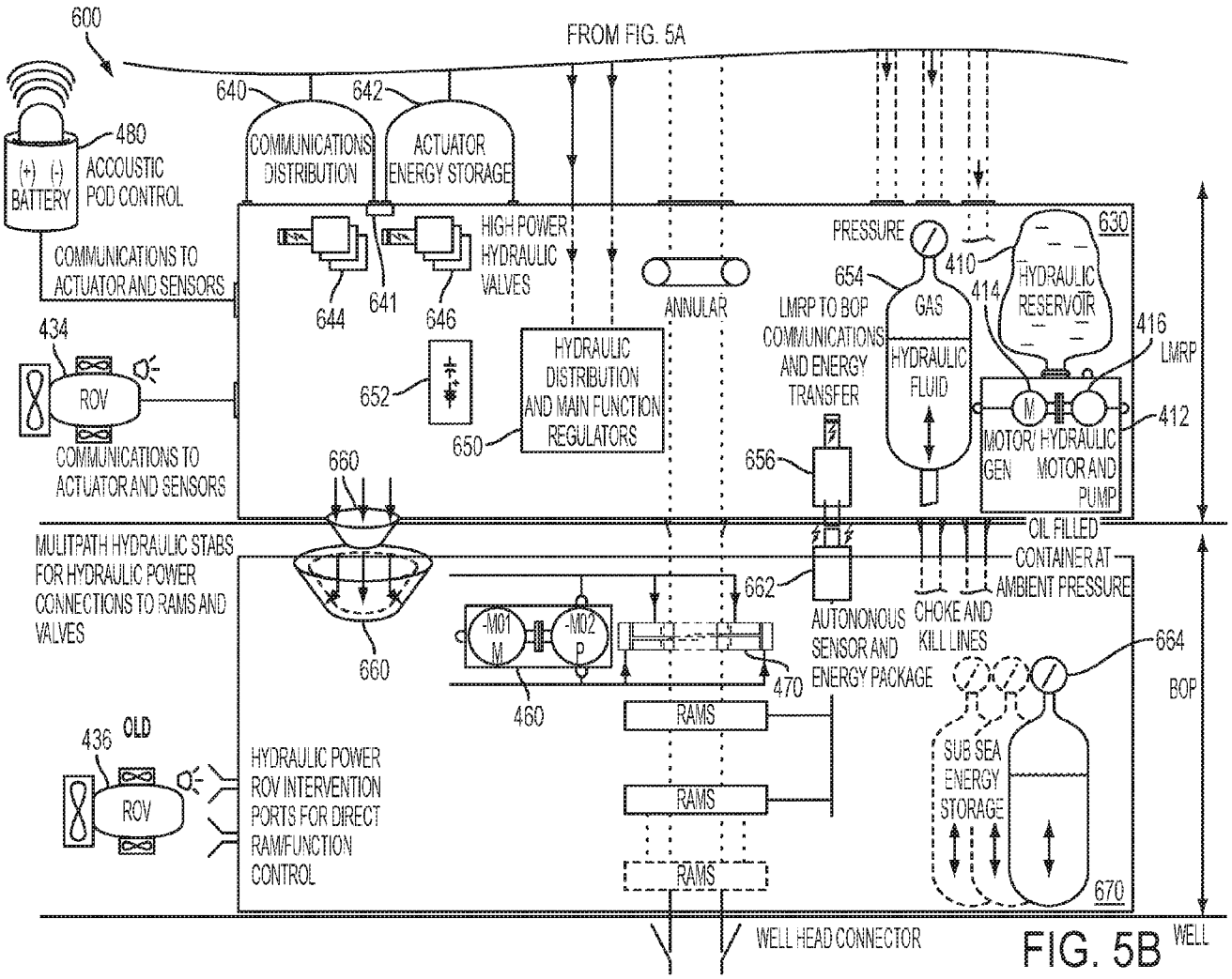
FIG. 5B is a block diagram depicting one configuration of a blowout preventer (BOP) system according to one embodiment of the present disclosure.

FIGS. 5A and 5B depict one embodiment of the present disclosure in the configuration of a subsea LMRP and BOP attached to a riser string. Vessel-mounted hardware 610 of system 600 may sit topside and include hydraulic fluid storage 616, hydraulic pump 614, and/or hydraulic reservoir 612. Hydraulic fluid may be delivered through fluid supply line 452 or secondary supply line 453. Communication and power may be delivered via umbilical 450 or secondary umbilical 451. According to one embodiment, umbilicals may be configured to carry power independently of communication. For example, umbilical 450 may carry only power and umbilical 451 may carry only communication. This may reduce line noise and improve communication. For redundancy purposes, umbilicals may be reversed so that umbilical 451 carries only power and umbilical 450 carries only communication, or either umbilical may be configured to carry both simultaneously. Likewise, electronics packages 640 and 642 may be configured in tandem to be fully redundant or they can be set to operate in series, with electronics package 640 dedicated to power conditioning and supply, and electronics package 642 dedicated to communications and control. Electronics packages 640 and 642 may be coupled by power and communications line 641. Electronics packages 640 and 642 may be located within LMRP 630 or mounted as pods, as shown in FIGS. 5A and 5B. Electronics packages 640 and/or 642 may power and control hydraulic valves 644 and 646 as well as hydraulic distribution and main function regulators 650. Electronics packages 640 and 642 may also manage and condition battery 652.

LMRP 630 may contain an independent hydraulic energy storage 654 or be connected to BOP 670 hydraulic energy storage 664 through, for example, multipath hydraulic stabs 660 for hydraulic power connections to rams and valves. Electric power and communications may be transferred between LMRP 630 and BOP 670 through communication and energy transfer ports 656 and 662. Ports 656 and 662 may be hardwire connected or wirelessly coupled through induction. BOP 670 may include multiple rams 470 surrounding well bore 454. In one embodiment, rams 470 may include independent hydraulic-operated valve and pump units 460. In other embodiments, hydraulic-operated valve and pump units 460 may be interconnected to control and monitor multiple rams 470.

The systems and methods described herein are scalable, and may be applied to either existing or new well equipment. Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method, comprising:

storing electrical energy near a well on a sea floor in an energy storage device, wherein the energy storage device is configured to provide stored electrical energy to operate well control equipment;

storing hydraulic energy near the well on the sea floor in a hydraulic energy storage tank, wherein the hydraulic energy storage tank is configured to provide stored hydraulic energy to operate the well control equipment;

operating a pump from the stored electrical energy to generate the stored hydraulic energy; and activating the well control equipment with a combination of the stored electrical energy and the stored hydraulic energy, wherein the step of activating the well control equipment with a combination of the stored electrical energy and the stored hydraulic energy comprises activating the well control equipment for a first duration of time with the stored electrical energy and activating the well control equipment for a second duration of time with the stored hydraulic energy.

2. The method of claim 1, wherein the step of activating the well control equipment comprises activating a shear ram, and wherein activating the shear ram comprises:

activating the shear ram with the stored electrical energy to move the shear ram a first distance; and activating the shear ram with the stored hydraulic energy to move the shear ram a second distance.

3. The method of claim 2, wherein the first distance is less than the second distance.

4. The method of claim 2, wherein the first distance is a portion of a path the shear ram traverses before contacting an obstruction.

5. The method of claim 4, wherein the obstruction is a drill pipe.

6. The method of claim 1, further comprising:

storing hydraulic medium at ambient-pressure near the well on the sea floor; and pressurizing the hydraulic medium with the pump powered by the stored electrical energy.

7. The method of claim 6, further comprising receiving ambient-pressure hydraulic medium from a remotely-operated vehicle (ROV).

8. The method of claim 1, further comprising:

receiving pressurized hydraulic medium from a remotely-operated vehicle (ROV); and operating the pump as a generator from the received pressurized hydraulic medium to recharge the stored electrical energy.

9. The method of claim 1, further comprising returning hydraulic medium to be re-used in the well control equipment.

10. The method of claim 1, further comprising:

receiving data from a sensor near the well; and activating the well control equipment based on data received from the sensor.

11. The method of claim 10, further comprising:

recording data from the sensor for a period of time;

comparing the recorded data to at least one of a predetermined event signature and a historical event signature; and determining an event has occurred involving the well control equipment based, at least in part, on the step of comparing.

12. An apparatus, comprising:

well control equipment;

a subsea electrical power supply coupled to the well control equipment and configured to provide stored electrical energy to operate the well control equipment;

a hydraulic reservoir configured to provide stored hydraulic energy;

a hydraulic line coupled to the hydraulic reservoir and coupled to the well control equipment, the hydraulic line configured to supply the well control equipment with the stored hydraulic energy; and a control system configured to operate the well control equipment with a combination of the stored electrical energy and the stored hydraulic energy, wherein the control system is configured to:

operate the well control equipment for a first time period with the stored electrical energy; and operate the well control equipment for a second time period with the stored hydraulic energy.

13. The apparatus of claim 12, wherein the control system is configured to operate a shear ram, and wherein the control system is configured to operate the shear ram by performing steps comprising:

operating the subsea electrical power supply to move the shear ram a first distance using the stored electrical energy; and operating a hydraulic actuator to move the shear ram a second distance using the stored hydraulic energy.

14. The apparatus of claim 12, further comprising:

a hydraulic valve; and a hydraulic actuator coupled to the hydraulic valve, wherein the control system is coupled to the hydraulic actuator and coupled to the subsea electrical power supply, the control system being configured to operate the well control equipment with stored electrical energy from the subsea electrical power supply and with stored hydraulic energy from the hydraulic line.

15. The apparatus of claim 12, further comprising a sensor coupled to the control system, in which the control system is configured to activate the well control equipment based, at least in part, on data received from the sensor.

16. The apparatus of claim 15, in which the control system is further configured to:

record data from the sensor for a period of time to obtain recorded data;

compare the recorded data to at least one of a predetermined event signature and a historical event signature; and determine an event involving the well control equipment has occurred based, at least in part, on the step of comparing.

17. The apparatus of claim 12, further comprising a subsea pump coupled to the hydraulic line and coupled to the subsea electrical power supply, the subsea pump configured to generate hydraulic pressure in the hydraulic line from the stored electrical energy in the subsea electrical power supply.

18. The apparatus of claim 17, in which the hydraulic reservoir comprises an ambient-pressure hydraulic reservoir, and in which the subsea pump is configured to pressurize hydraulic medium of the ambient-pressure hydraulic reservoir to operate the well control equipment using the hydraulic line.

19. The apparatus of claim 12, further comprising a port configured to receive ambient-pressure hydraulic medium from a remotely-operated vehicle.

20. The apparatus of claim 17, further comprising a port configured to receive pressurized hydraulic medium from a remotely-operated vehicle (ROV), in which the subsea pump is configured to operate as a generator to recharge the subsea electrical power supply from the received pressured hydraulic medium.

21. A method, comprising:

storing electrical energy near a well on a sea floor in an energy storage device, wherein the energy storage device is configured to provide stored electrical energy to operate well control equipment;

storing hydraulic energy near the well on the sea floor in a hydraulic energy storage tank, wherein the hydraulic energy storage tank is configured to provide stored hydraulic energy to operate the well control equipment;

operating a subsea pump from the stored electrical energy to generate the stored hydraulic energy;

activating the well control equipment with a combination of the stored electrical energy and the stored hydraulic energy;

receiving pressurized hydraulic medium from a remotely-operated vehicle (ROV); and operating the subsea pump as a generator from the received pressurized hydraulic medium to recharge the stored electrical energy.

22. The method of claim 21, wherein the step of activating the well control equipment with a combination of the stored electrical energy and the stored hydraulic energy comprises activating the well control equipment for a first duration of time with the stored electrical energy and activating the well control equipment for a second duration of time with the stored hydraulic energy.

23. An apparatus, comprising:

well control equipment;

a subsea electrical power supply coupled to the well control equipment and configured to provide stored electrical energy to operate the well control equipment;

a hydraulic reservoir configured to provide stored hydraulic energy;

a hydraulic line coupled to the hydraulic reservoir and coupled to the well control equipment, the hydraulic line configured to supply the well control equipment with the stored hydraulic energy;

a control system configured to operate the well control equipment with a combination of the stored electrical energy and the stored hydraulic energy;

a subsea pump coupled to the hydraulic line and coupled to the subsea electrical power supply, the subsea pump configured to generate hydraulic pressure in the hydraulic line from the stored electrical energy in the subsea electrical power supply; and a port configured to receive pressurized hydraulic medium from a remotely-operated vehicle (ROV), in which the subsea pump is configured to operate as a generator to recharge the subsea electrical power supply from the received pressured hydraulic medium.

24. The apparatus of claim 23, wherein the control system is configured to:

operate the well control equipment for a first time period with the stored electrical energy; and operate the well control equipment for a second time period with the stored hydraulic energy.

* * * * *